US006860822B2

(12) United States Patent
Vrska, Jr.

(10) Patent No.: US 6,860,822 B2
(45) Date of Patent: Mar. 1, 2005

(54) PUTTER HAVING AN INSERT OF VARIABLE THICKNESS

(75) Inventor: Michael D. Vrska, Jr., Rolling Meadows, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 09/945,485

(22) Filed: Aug. 30, 2001

(65) Prior Publication Data

US 2003/0045372 A1 Mar. 6, 2003

(51) Int. Cl.[7] ..... A63B 53/04

(52) U.S. Cl. ..... 473/324; 473/329; 473/332; 473/340

(58) Field of Search ..... 473/329, 332, 473/334, 336, 338, 340, 324, 342, 344, 349, 350, 335, 473, 234

(56) References Cited

U.S. PATENT DOCUMENTS

| | | | | | |
|---|---|---|---|---|---|
| 4,156,526 | A | | 5/1979 | Huggins et al. | 273/78 |
| 4,569,524 | A | | 2/1986 | Quijano | 273/173 |
| 4,872,683 | A | | 10/1989 | Doran et al. | 273/164 |
| 4,979,744 | A | * | 12/1990 | Alcala | 273/DIG. 23 |
| 5,190,290 | A | | 3/1993 | Take | 273/169 |
| 5,398,929 | A | | 3/1995 | Kitaichi | 273/78 |
| 5,405,136 | A | | 4/1995 | Hardman | 273/173 |
| 5,497,993 | A | | 3/1996 | Shan | 273/167 |
| 5,529,543 | A | | 6/1996 | Beaumont, Sr. | 473/290 |
| 5,551,694 | A | * | 9/1996 | Grim et al. | 473/234 |
| 5,605,510 | A | * | 2/1997 | Schmidt et al. | 473/251 |
| 5,655,976 | A | * | 8/1997 | Rife | 473/335 |
| 5,669,829 | A | | 9/1997 | Lin | 473/346 |
| 5,766,093 | A | | 6/1998 | Rohrer | 473/329 |
| 5,769,737 | A | * | 6/1998 | Holladay et al. | 473/336 |
| 5,807,190 | A | | 9/1998 | Krumme et al. | 473/342 |
| 5,830,078 | A | * | 11/1998 | McMahan | 473/252 |
| 5,931,743 | A | | 8/1999 | Baker et al. | 473/313 |
| 5,931,746 | A | | 8/1999 | Soong | 473/329 |
| 5,944,619 | A | | 8/1999 | Cameron | 473/332 |
| 6,270,422 | B1 | * | 8/2001 | Fisher | 473/223 |
| 6,273,831 | B1 | * | 8/2001 | Dewanjee | 473/324 |
| 6,273,832 | B1 | * | 8/2001 | Helmstetter et al. | 273/DIG. 22 |
| 6,302,807 | B1 | * | 10/2001 | Rohrer | 473/329 |
| 6,368,232 | B1 | * | 4/2002 | Hamada et al. | 473/329 |
| 6,431,997 | B1 | * | 8/2002 | Rohrer | 473/324 |

* cited by examiner

*Primary Examiner*—Glenn Caldarola
*Assistant Examiner*—Tom P Duong
(74) *Attorney, Agent, or Firm*—Terence P. O'Brien

(57) ABSTRACT

A putter head including a toe portion, a heel portion, a generally vertically extending wall and an insert. The wall has a front strike face, a rear surface, an upper layer, and a lower layer. The upper layer, the lower layer and the rear surface each extend from the heel portion to the toe portion to define a recess rearwardly extending into the wall from the strike face. The rear surface of the wall is formed with variable thickness thereby providing the recess with a variable rearward depth. The insert substantially fills the recess and connects to the wall. The insert has a front surface, a top surface, a bottom surface and a rear surface. The front surface is exposed, while the top and bottom surfaces are substantially covered by the wall.

34 Claims, 12 Drawing Sheets

PUTTER HAVING AN INSERT OF VARIABLE THICKNESS

FIELD OF THE INVENTION

The present invention relates generally to a golf putter. In particular, the present invention relates to a golf putter including a putter head having an insert of variable thickness or rearward depth.

BACKGROUND OF THE INVENTION

Putters are well known and include a putter head having a front strike face. Putters typically have an intended contact region centrally positioned on the strike face and commonly referred to as the "sweet spot." The intended contact region is often generally indicated by a sight line that rearwardly extends from the strike face at an angle perpendicular to the strike face. When a user contacts a golf ball with the putter at the intended contact region of the strike face, the putter typically generates an amount of audible and vibrational energy that provides the user with sound indicative of solid contact with a ball and a corresponding "good feel." Most importantly, the ball, upon contact with the intended contact region of the strike face, will typically and consistently travel a distance that is directly proportional to the speed of the putter head at impact.

Conversely, when a user contacts the golf ball at a position away from the intended contact region, commonly referred to as a "mis-hit," the ball will typically travel a distance that is significantly less than that of a ball contacted at the intended contact region of the strike face. Moreover, the distance loss can be variable and unpredictable. In an effort to increase the size of the sweet spot of a putter, many putter heads are configured with an increased toe and heel weighting, which increases the putter head's moment of inertia. A putter head with an increased moment of inertia is more resistant to twisting during a mis-hit and, therefore, enables the performance of a mis-hit ball to more closely match the performance of a ball contacted at the sweet spot. However, increased toe and heel weighting alone generally does not eliminate the distance loss that typically occurs during off-center hits.

In efforts to improve the feel of a putter upon impact, many putters include an insert, typically of uniform thickness, mounted into the strike face and/or within the putter head. Such inserts are typically made of a material that is softer than the material of the putter head. Although such soft inserts provide a more desirable softer feel to the user upon impact with a ball, such inserts also typically substantially deaden the sound produced upon impact with the ball making it difficult for the user to measure his or her putting stroke using audible feedback from the putter. Moreover, inserts of uniform thickness typically do not increase the size of the sweet spot or otherwise improve the putter's performance during mis-hits.

Although putters having inserts of varying thickness or depth are known, such inserts are typically connected to the putter head with an adhesive agent that does not allow for uniform direct contact between the insert and the putter head. Moreover, it is not uncommon for adhesives to be unevenly applied or positioned between the insert and the putter head, due to normal manufacturing tolerances. The uneven application of adhesive can result in the development of gaps in random locations throughout the connection region of the insert to putter head. Further, excessively thin, or excessively thick, layers of adhesive can result in the formation of "dead spots" and/or "hot spots" randomly positioned on the strike face of the putter head. Such dead spots and/or hot spots can detrimentally affect the performance of the putter, and severely hinder a user's ability to hit a ball a consistent distance and to develop a feel for the putter. Further, one type of existing putter having an insert of varying thickness also has an exposed upper surface in addition to an exposed front surface. The exposed surfaces of the insert make the insert more susceptible to damage or dislocation from the putter head particularly during insertion and removal of the putter from a golf bag. Additionally, another known putter having an insert of varying thickness also includes multiple pieces inserted into the putter head with no one single insert extending over the entire intended strike region of the strike face. Such a putter is difficult to produce and fails to meet the U.S. Golf Association's requirements for putters.

Thus, there is a continuing need for a putter including an insert of varying rearward depth or thickness that increases the size of the putter's sweet spot thereby improving the putter's performance in response to a mis-hit. There is also a continuing need for a putter having an insert of variable thickness that does not include gaps, hot spots or dead spots over the area connecting the insert to the putter head. What is also needed is a putter with an insert of varying thickness that does not produce a deadened sound upon impact with a golf ball. Moreover, it would be advantageous to provide a putter having an insert that is protected from damage or dislocation during use. It would also be advantageous to provide a putter with an insert of varying thickness that satisfies the U.S. Golf Association's requirements for putters.

SUMMARY OF THE INVENTION

The present invention provides a putter head including a toe portion, a heel portion, a generally vertically extending wall and an insert. The wall has a front strike face, a rear portion, an upper layer, and a lower layer. The upper layer, the lower layer and the rear portion each extend from the heel portion to the toe portion to define a recess rearwardly extending into the wall from the strike face. The rear surface of the wall is formed with variable thickness thereby providing the recess with a variable rearward depth. The insert substantially fills the recess and connects to the wall. The insert has a front surface, a top surface, a bottom surface and a rear surface. The front surface is exposed, while the top and bottom surfaces are substantially covered by the wall.

According to a principal aspect of a preferred form of the invention, a putter head includes a generally vertically extending wall and a single insert. The wall has a front strike face and a rear surface. The wall also has an insert region at the strike face defining a rearwardly extending recess of varying rearward depth. The insert is castably formed in the recess of the insert region. The insert has a variable rearward depth to substantially fill the recess. The insert contacts the insert region of the wall.

According to another preferred aspect of the invention a putter head includes a toe portion, a heel portion, a generally vertically extending wall, an insert, and a sole portion. The wall extends from the toe portion to the heel portion. The wall has a front strike face and a rear surface. A rearwardly extending recess is defined into the strike face of the wall. The recess has a varying rearward depth. The insert substantially fills the recess and connects to the wall. The sole portion rearwardly extends from a lower portion of the wall and has an elongate sole slot. The sole slot is disposed rearward of the insert and substantially parallel to the strike face.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
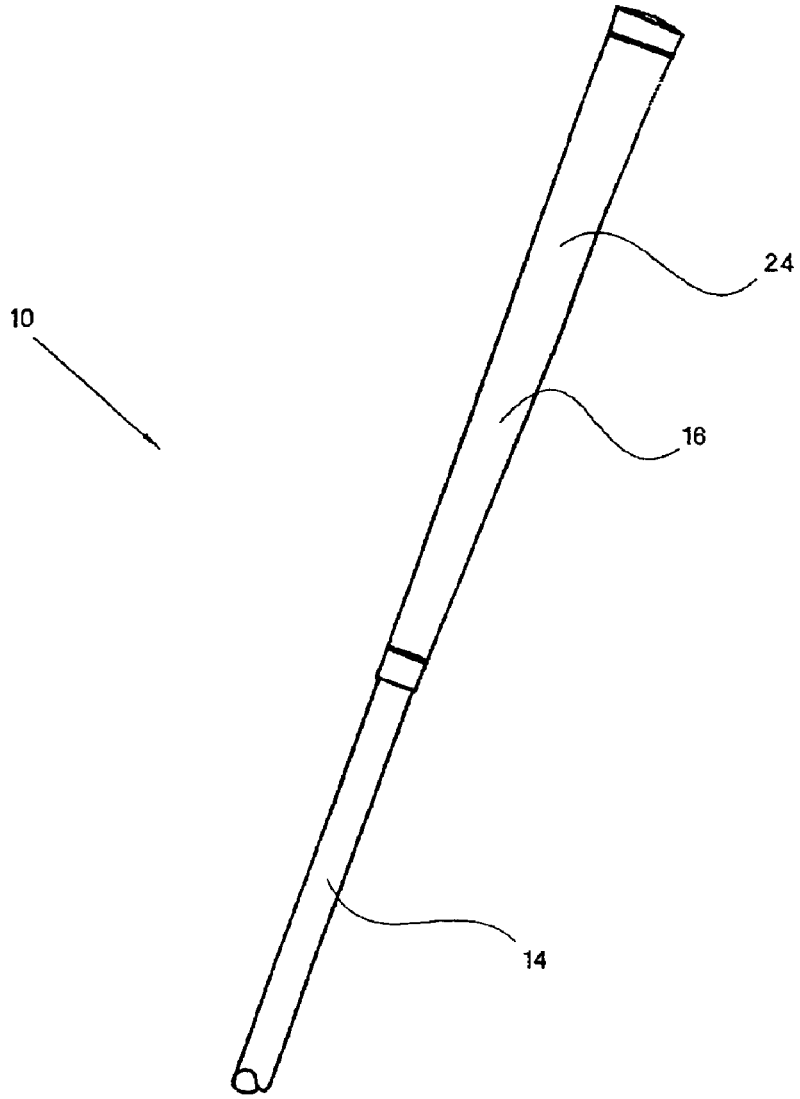
FIG. 1 is a front view of a golf putter in accordance with a preferred embodiment of the present invention.
Figure 1:
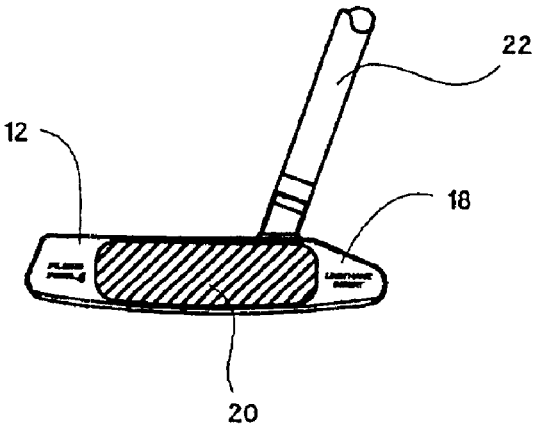

Referring to FIG. 1, a golf putter is indicated generally at 10. The putter 10 includes a putter head 12, a shaft 14 and a grip 16. The putter head 12 is an elongate body coupled to the shaft 14. Preferably, the putter head 12 is affixed to the shaft 14 with an epoxy adhesive. The putter head 12 includes a main body 18 and an insert 20. The main body is formed of a high strength, durable material, preferably a stainless steel. In alternative preferred embodiments, the body can be formed of other materials, such as, for example, titanium, bronze, copper, ceramics or other metals.

The shaft 14 is an elongate tube having a distal end 22, which is coupled to the club head 12, and a proximal end 24, which is slidably connected to the grip 16. The shaft 14 is made of a generally lightweight, strong material, preferably graphite or steel. Alternatively, the shaft can be formed of other materials, such as, for example, other metals, alloys or composites. In a preferred embodiment, the shaft 14 includes an inward taper that generally extends from the proximal end 24 to the distal end 22. Alternatively, the shaft 16 can be formed having a uniform diameter along its length. The distal end 22 or tip of the shaft 14 preferably has a diameter of 0.450 inches. Other shaft diameters are also contemplated.

The grip 16 is a conventional handle structure of generally hollow construction. The grip 16 has an open end configured for slidably receiving the proximal end 24 of the shaft 14. The grip 16 is formed of a generally soft resilient material, such as, for example, rubber, polyurethane, leather, a thermoplastic or an elastomer. Alternatively, the grip 16 can be formed of two or more layers of material. In yet another alternative embodiment, the grip 16 can be formed by wrapping of one or more tapes about the proximal end 24 of the shaft 14.

Figure 2:
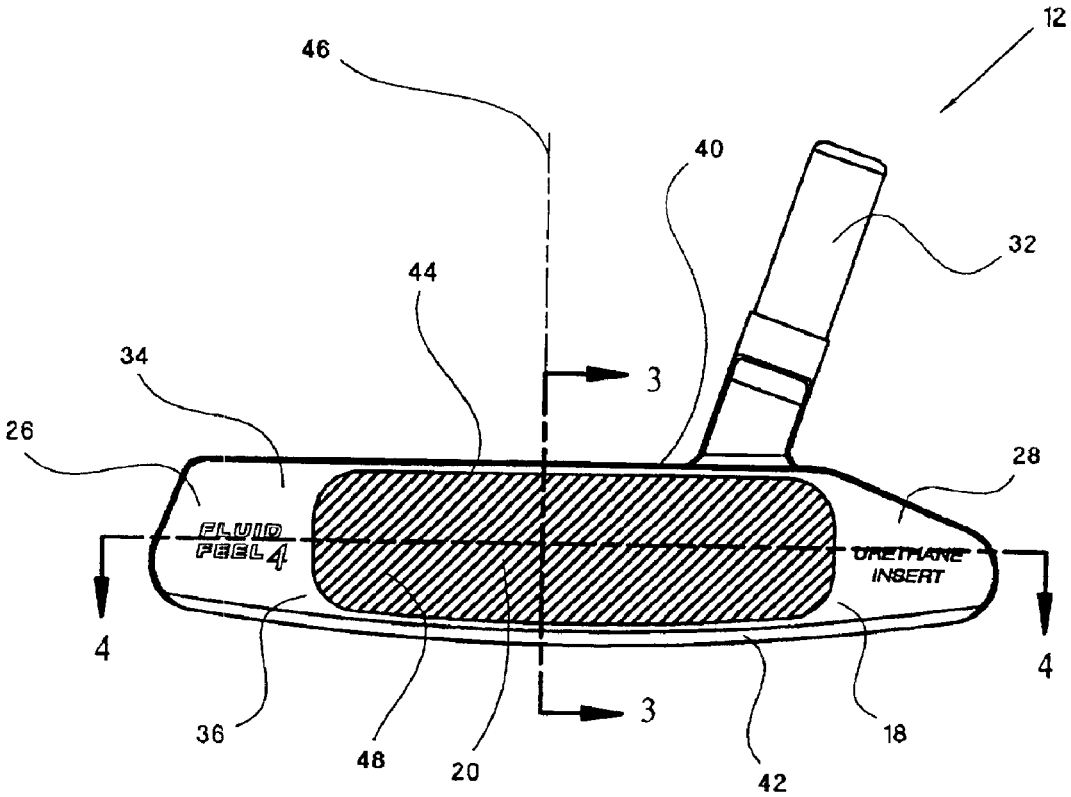
FIG. 2 is a front view of a putter head of FIG. 1.
Figure 3:
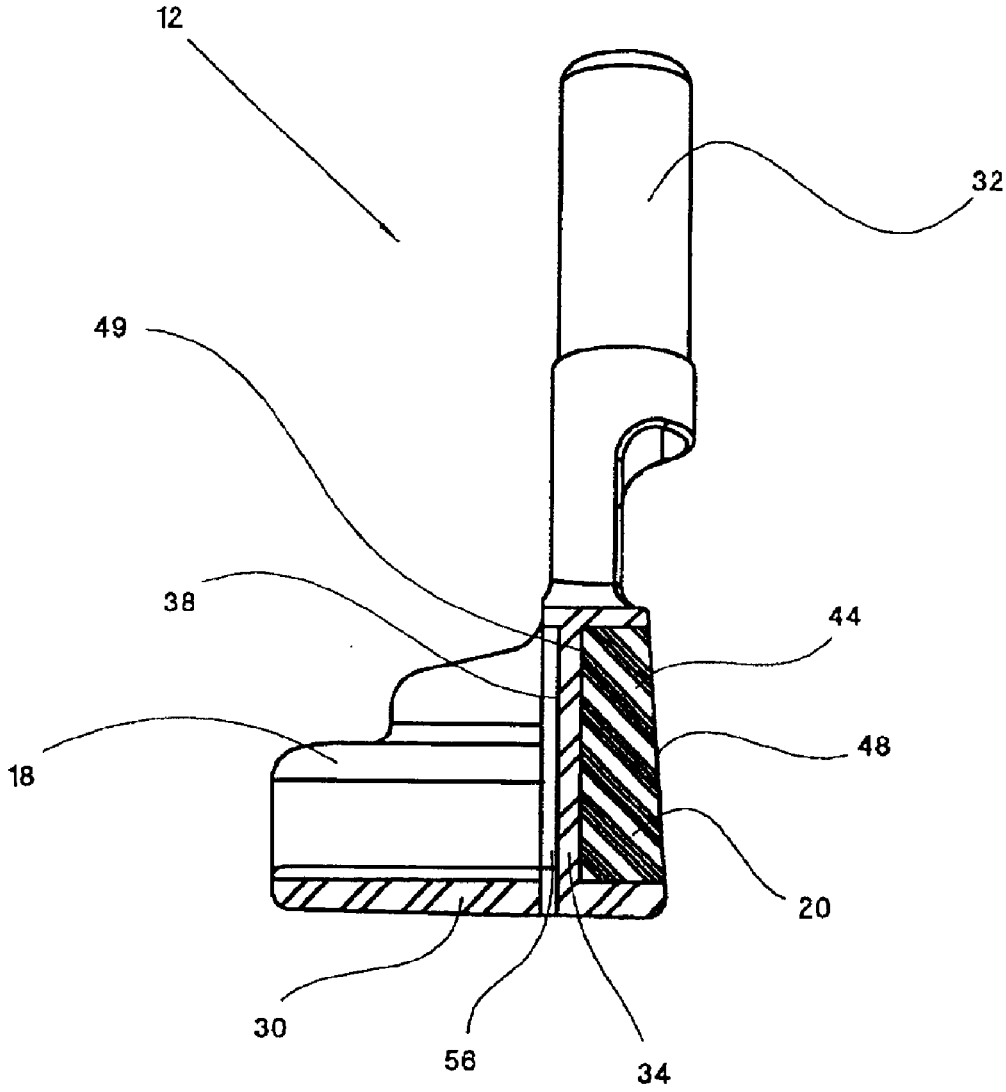
FIG. 3 is a cross-sectional side view of the putter head taken along line 3—3 of FIG. 2.
Figure 4:
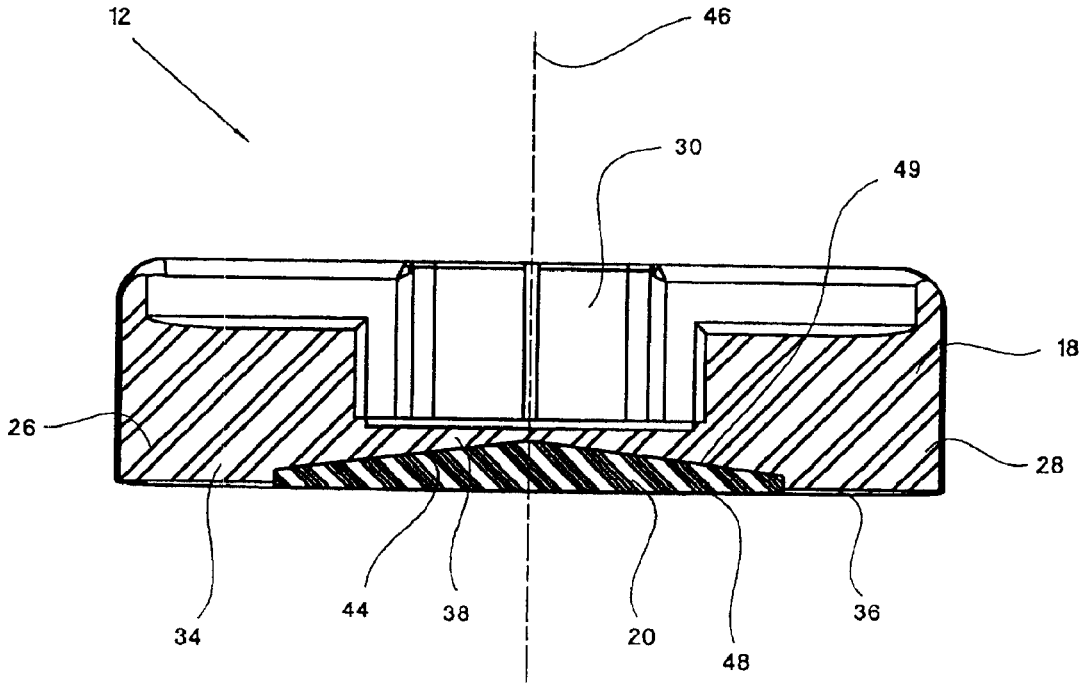
FIG. 4 is a cross-sectional top view of the putter head taken along line 4—4 of FIG. 2.

Referring to FIGS. 2–4, the main body 18 and the insert 20 of the putter head 12 are shown in greater detail. The main body 18 includes a toe portion 26, a heel portion 28, a sole portion 30, a hosel 32 and a front wall 34. Referring to FIG. 3, the sole portion 30 rearwardly extends from the front wall 34. Referring to FIG. 4, the sole portion 30 also outwardly extends from the heel portion 28 to the toe portion 26. Referring to FIGS. 2 and 3, the hosel 32 is a cylindrical member preferably upwardly extending from the heel portion 28. Alternatively, the hosel 32 can upwardly extend from the front wall 34 or the sole portion 30. In a preferred embodiment, the hosel 32 is a tapered extension configured for slidably engaging the distal end 22 of the shaft 14. In an alternative preferred embodiment, the hosel 32 includes a hole (not shown) for receiving the distal end 22 of the shaft 14.

Referring to FIGS. 2–4, the front wall 34 is a generally planar, generally vertical member extending from the heel portion 28 to the toe portion 26. The front wall 34 is preferably integrally formed to the sole portion 30 and the hosel 32. The front wall 34 includes a front strike face 36, a rear portion 38, an upper layer 40 and a lower layer 42. In a preferred embodiment, the strike face 36 and other locations on the main body 18 also include alphanumeric indicia and/or graphical images representative of product characteristics, source of the putter and other related information.

The rear portion 38, and the upper and lower layers 40 and 42 define a recess 44 rearwardly extending from the front strike face 36 into the front wall 34. The recess 44 preferably extends over a central region of the front wall 34 from the heel portion 28 to the toe portion 26, and is configured to receive the insert 20. Referring to FIG. 4, the thickness of the rear portion 38 varies at various points along the recess 44 to provide the recess 44 with a variable rearward depth. Preferably, the rearward depth of the recess 44 is greatest along a vertical plane 46 centrally located along the front wall 34 and extending substantially perpendicular to the strike face 36. The rearward depth of the recess 44 gradually and uniformly decreases further away from the plane 46 toward the toe and heel portions 26 and 28 to form a uniform taper from the plane 46 toward each of the toe and heel portions 26 and 28. In a particularly preferred embodiment, the rearward depth or thickness of the insert 20 at the plane 46 is approximately 0.275 inches and the rearward depth or thickness of the insert 20 at each end of the recess 44 is approximately 0.105 inches. The insert 20 and the recess 44 can also be configured in different sizes.

The insert 20 is an elongate member coupled to the main body 18 at the recess 44. The insert 20 includes the front surface 48, a rear surface 49, a top surface and a bottom surface. Preferably, the insert 20 is castably formed to the front wall 34 at the recess 44 without the use of an adhesive or an adhesive agent. In a preferred embodiment, the castable formation of the insert 20 to the front wall 34 is accomplished by initially obtaining the material of the insert 20 in a liquid or fluid state and pouring the material of the insert 20 into the recess 44. The liquid state of the material of the insert 20 enables the material of the insert 20 to directly, continuously and uniformly engage the surfaces it comes in contact with, including all surface imperfections of such surfaces. The molten or fluid material of the insert 20 preferably directly, continuously and uniformly contacts the entire surface area of the inner surfaces of the rear portion 38, the upper layer 40 and the lower layer 42 of the front wall 34 forming the recess 44, including the surface imperfections of these inner surfaces. This uniform and complete contact between the material of the insert 20 and the inner surfaces of the front wall 34 remains in place as the insert 20 cures from a liquid to a solid. The insert 20 takes the form of the recess 44. Preferably, the material of the insert 20 substantially fills the recess 44 such that, upon curing, a front surface 48 of the insert 20 is generally flush, or coplanar, with the strike face 36 of the front wall 34. In a particularly preferred embodiment, the front surface 48 is milled to ensure that the front surface of the insert 20 is flush with the strike face 36. Preferably, the front wall 34 substantially covers the rear surface 49 and the top and bottom surfaces of the insert 20. The castable formation of the insert 20 to the body 18 provides an optimum connection between the insert 20 and the body 18 without the use of an adhesive or an adhesive agent.

Uneven application of adhesive often leads to the development of randomly positioned "hot spots" or "dead spots", within the putter head. Further, it is not uncommon for air gaps, or air pockets, to exist between an insert and the main body of a putter head. Such air gaps, "hot spots" or "dead spots can severely negatively impact the performance of a putter head. The uniform and complete contact between the material of the insert 20 and the inner surfaces of the front wall 34 substantially reduces or eliminates the development of air gaps or air pockets between the insert 20 and the inner surfaces of the front wall 34. Moreover, because the castable formation of the insert 20 to the front wall 34 eliminates the need for an adhesive, the often random distribution of the adhesive across the insert and the inner surfaces of the front wall, and the resulting hot spots and dead spots, are substantially eliminated.

The insert 20 is made of a lightweight material, preferably a castable urethane that is softer than the material of the body 18 of the putter head 12. In a particularly preferred embodiment, the insert 20 weighs approximately 6 grams. Inserts having different weights are also contemplated. The material of the insert 20 preferably has a durometer of between 40 and 65 on a Shore A hardness scale. In a particularly preferred embodiment, the material of the insert 20 has a durometer of between 45 and 55 on a Shore A hardness scale. Shore A durometer values provided in this specification are in accordance with ASTM Standard D2240 entitled, "Standard Test Method for Rubber Property—Durometer Hardness." In alternative preferred embodiments, the insert 20 can be made of other materials, such as, for example, an epoxy resin, a thermoplastic, a thermoset material, an elastomer, other urethanes and combinations thereof. In another alternative preferred embodiment, the insert 20 is made of a translucent material. Additionally, the material of the insert 20 preferably includes a colorant enabling the insert 20 to be formed in a variety of single colors or multi-color combinations. The colorant also improves the aesthetics of the putter head 12. In another alternative embodiments, the insert 20 can be coupled to the main body 18 through other means, such as, for example, press-fit, interference fit, affixed or fastened.

The variable thickness, or variable rearward depth, of the insert 20 enables the putter head 12 to substantially reduce or eliminate the distance loss resulting from inaccurate or off-center contact of the putter head 12 with a ball. The intersection of the plane 46 and the strike face 36 identifies an intended strike point of the putter head 12. Typically, when a putter head contacts a ball at a predetermined velocity at the intended strike point, the ball will travel a specific distance. Further, when a ball is mis-hit, or contacted at a predetermined velocity by the putter head at a point away from the intended strike face, the ball will typically travel a shorter unpredictable distance, and often generally at a mis-directed angle, than a ball hit at the intended strike point. Such distance loss and misdirection can significantly negatively affect the overall performance of putters. The configuration of the insert 20 and the main body 18 minimizes or eliminates the amount of distance lost and/or the degree of misdirection resulting from a mis-hit by reducing the rearward depth of the insert 20 further away from the plane 46 and by reducing the amount of energy absorbed by the insert 20. At the intended strike point along plane 46, the putter head 12 has the greatest thickness of the soft insert material resulting in the largest amount of energy absorption when contacting a ball. At contact points further away from the plane 46 toward either the toe portion or the heel portion of the main body 18, the thickness of the insert 20 is reduced. As a result, when the putter head 12 contacts a ball at these points away from the intended strike point, less energy is absorbed by the putter head 12 and more energy is transferred from the putter head 12 to the ball causing the ball to travel a greater distance. This increased distance generally compensates for the distance loss resulting from the mis-hit, and, in effect, functions to increase the size of the putter head's sweet spot.

The soft material of the insert 20 provides the putter 10 and the user with a soft feel. The performance of the putter head 12, particularly in response to mis-hits, is further improved by maximizing the weighting of the putter head 12 toward the heel and toe portions 28 and 26 and thereby maximizing the moment of inertia of the putter head 12 and its resistance to twisting during mis-hits. Here, the lightweight material, and the central positioning, of the insert 20 transfers more weight to the heel and toe portions 28 and 26 of the putter head 12. Further, the putter head 12 satisfies the existing U.S. Golf Association requirements for putters including the requirement that a single material be used on the striking face of the putter head.

Figure 5:
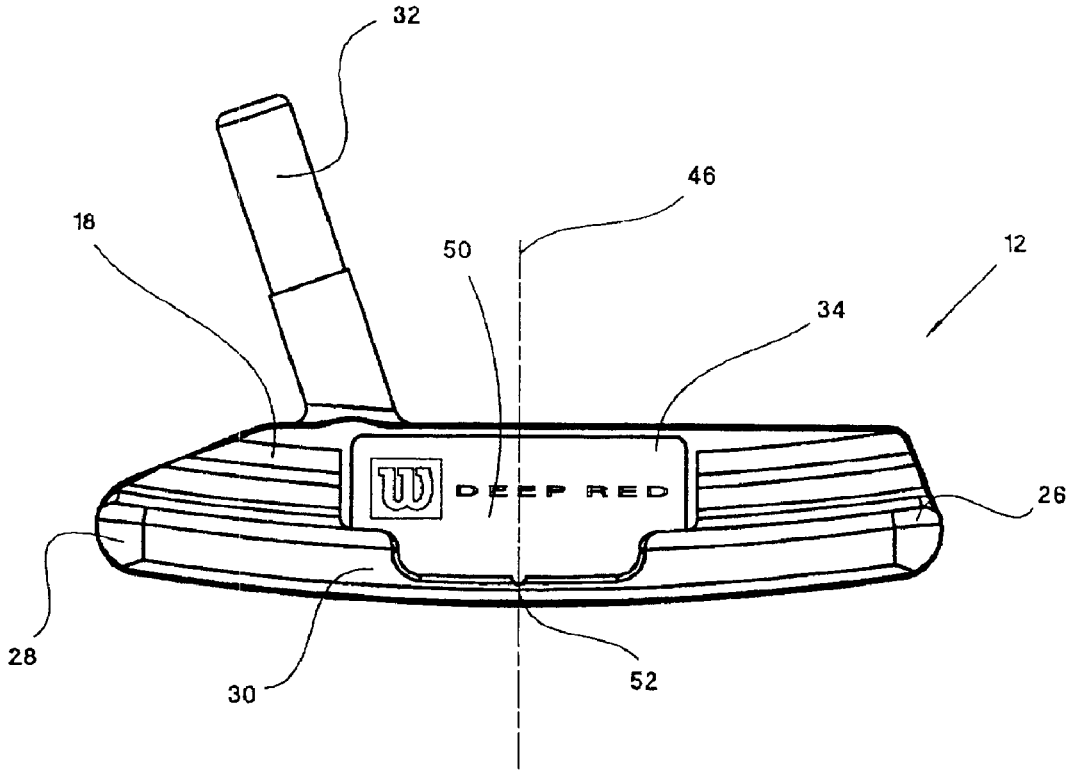
FIG. 5 is a rear view of the putter head of FIG. 2.
Figure 6:
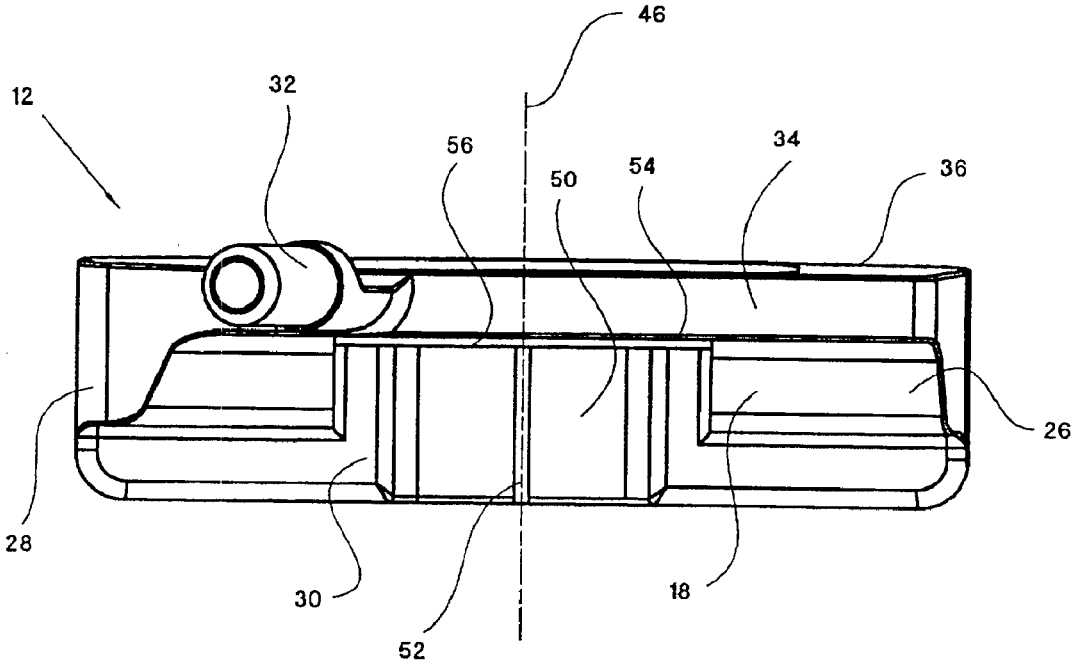
FIG. 6 is a top view of the putter head of FIG. 2.

Referring to FIGS. 5 and 6, the sole portion 30 and the front wall 34 are shown in greater detail. The sole portion 30 includes a centrally positioned, downwardly extending cavity 50 and a sight line 52. The cavity 50 preferably extends across the entire depth of the sole portion 30. The cavity 50 further displaces weight from the putter head 12 toward the heel and toe portions 28 and 26 of the putter head 12. The increased heel and toe weighting increases the moment of inertia of the putter head 12 and its resistance to twisting in response to mis-hit shots. In alternative embodiments, the cavity 50 can be shaped or sized differently.

The sight line 52 is preferably a groove downwardly extending into the sole portion 30. The sight line 52 extends across the sole portion 30 preferably along the plane 46. The sight line 52 assists the user in identifying the intended strike point of the putter head 12 and assist the user in properly lining up or measuring his or her putt. In alternative embodiments, the sight line 52 can be a raised projection or a line drawn onto the sole portion. In an alternative embodiment, the sight line can be a plurality of lines, each rearwardly extending from the front wall 34 at a position parallel to the plane 46.

Referring to FIG. 6, the cavity 50 and overall configuration of the sole portion 30 enable a top rear line 54 of the front wall 34 to be prominently seen. Preferably, the overall thickness or depth of the front wall 34 is less than the depth of the sole portion 30 thereby enabling the sight line 52 to be prominently displayed when viewing the putter from above and positioning the top rear line 54 of the front wall 34 relatively close to the front strike face 36 of the front wall 34. The sight line 52 and/or the top rear line 54 of the front wall 34 can be used to facilitate proper alignment of the putter 10 before and during a putt.

Figure 7:
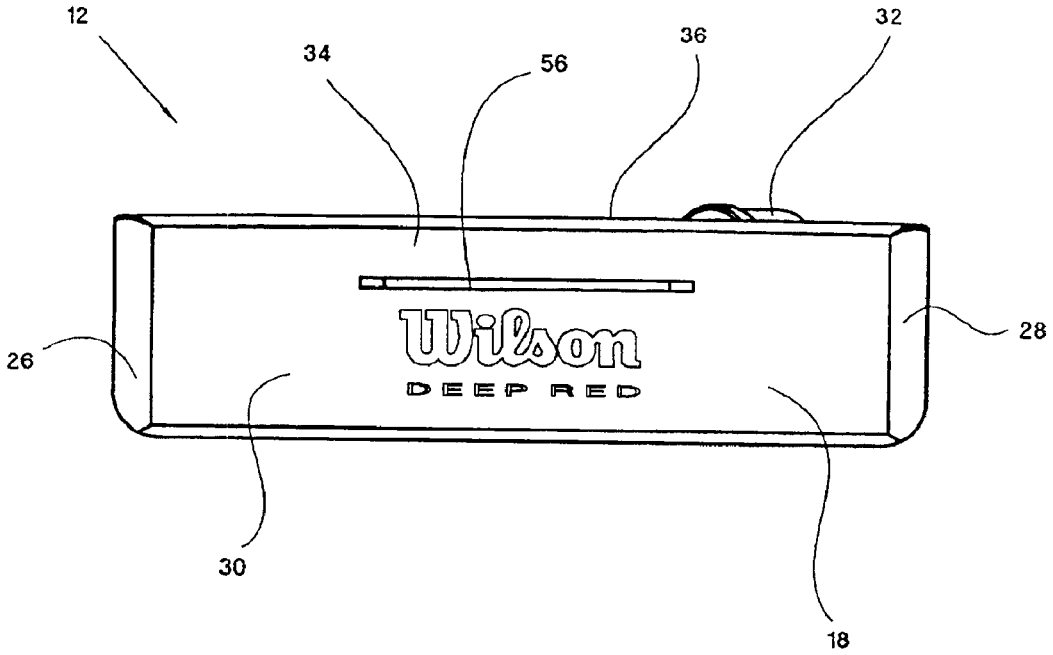
FIG. 7 is a bottom view of the putter head of FIG. 2.

Referring to FIGS. 6 and 7, the putter head 12 further includes an elongate sole slot 56 extending through the putter head 12 from the heel portion 28 to the toe portion 26, and between the front wall 34 and the sole portion 30. In a particularly preferred embodiment, the sole slot 56 has a thickness of 0.160 inches. In other preferred embodiments, other slot thicknesses can be used. The sole slot 56 increases and optimizes the sound generated by the putter head 12 during contact with a ball thereby enabling the user to readily adjust his or her putting stroke based, at least in part, upon the audible feedback generated by the putter head 12. The sole slot 56 is particularly advantageous when used in combination with the insert 20 due to the tendency for inserts, made of soft material, to reduce or deaden the sound generated by a putter during contact with a ball. The sole slot 56 enables a user to enjoy the soft feel that an insert 20 of soft material provides without negatively effecting the desirable sound produced by the putter 10. The generally centrally positioned sole slot 56 further displaces weight toward the toe and heel portions 26 and 28 of the putter head 12 which increases the moment of inertia of the putter head 12 as well as the putter head's resistance to twisting during off-center hits or mis-hits.

Figure 8:
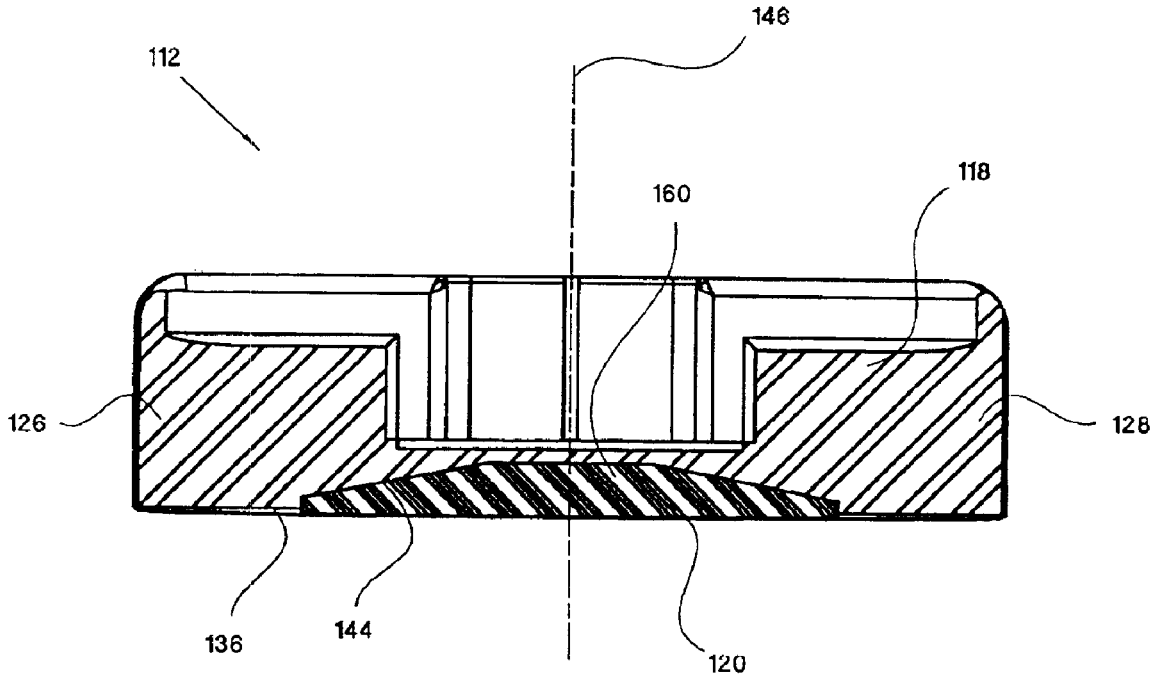
FIG. 8 is a cross-sectional top view of a putter head in accordance with another alternative preferred embodiment of the present invention.

FIG. 8 illustrates another preferred embodiment of the present invention. A putter head 112 includes a main body 118 and an insert 120. The main body 118 has a toe portion 126, a heel portion 128 and a front strike face 136. The putter head 112 is substantially similar to the putter head 12 except that the main body 118 of the putter head 112 includes a generally trapezoidal shaped recess 144 and the insert 120 has a corresponding generally trapezoidal shape. The insert 120 has a maximum, generally uniform depth over a central portion 160 of the insert 120. A substantially vertical plane 146 extends perpendicular from the strike face 136 of the putter head 112 through the middle of the central portion 160. The central portion 160 extends from a central plane 146 in the direction of the toe portion 126 and the heel portion 128. The rearward depth of the insert 120 then decreases from the central portion 160 toward each of the toe and heel portions 126 and 128 of the putter head 112 forming a uniform taper from either side of the central portion 160 toward the heel and toe portions 128 and 126. Like the putter head 12, the putter head 112 also provides the improved response characteristics particularly for off-center hits.

Figure 9:
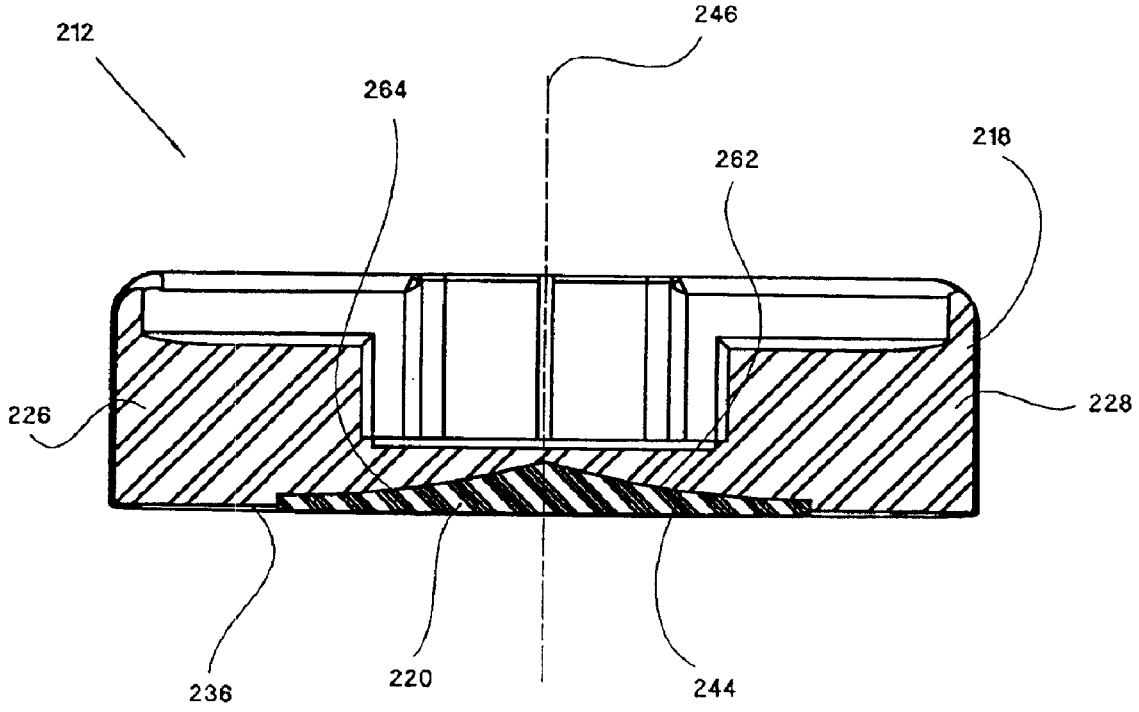
FIG. 9 is a cross-sectional top view of a putter head in accordance with another alternative preferred embodiment of the present invention.

FIG. 9 illustrates another preferred embodiment of the present invention. A putter head 212 includes a main body 218 and an insert 220. The main body 218 has a toe portion 226 and a heel portion 228. The putter head 212 is substantially similar to the putter head 12 except that the main body 218 of the putter head 212 includes a different shaped recess 244 and the insert 220 has a corresponding shape. The insert 220 has a maximum rearward depth or thickness at a centrally positioned vertical plane 246 extending through the putter head 12 perpendicular to a strike face 236 of the putter head 212. The rearward depth or thickness of the insert 220 then decreases from the plane 246 toward each of the heel portion 228 and the toe portion 226. The decrease in thickness of the insert 220 from the plane 246 to the toe and heel portions 226 and 228 is non-uniform and symmetrical about the plane 246 forming arcuate shaped first and second portions 262 and 264 of a rear surface of the insert 220. Like the putter head 12, the putter head 212 also provides the improved response characteristics particularly for off-center hits.

Figure 10:
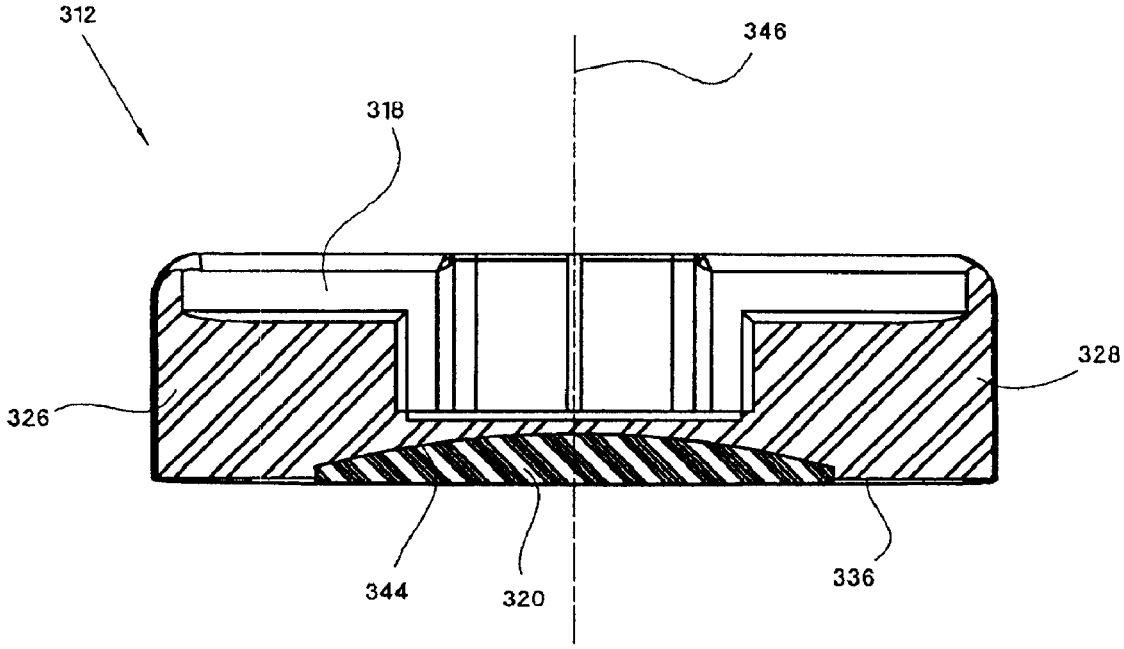
FIG. 10 is a cross-sectional top view of a putter head in accordance with another alternative preferred embodiment of the present invention.

FIG. 10 illustrates another preferred embodiment of the present invention. A putter head 312 includes a main body 318 and an insert 320. The main body 318 has a toe portion 326 and a heel portion 328. The putter head 312 is substantially similar to the putter head 12 except that the main body 318 of the putter head 312 includes a semi-elliptical or arcuate shaped recess 344 and the insert 320 has a corresponding semi-elliptical or arcuate shape. The insert 320 has a maximum rearward depth or thickness at a centrally positioned vertical plane 346 extending through the putter head 312 perpendicular to a strike face 336 of the putter head 312. The insert 320 is symmetrical about the vertical plane 346. The rearward depth or thickness of the insert 320 then decreases from the plane 346 toward each of the heel portion 328 and the toe portion 326. Like the putter head 12, the putter head 312 also provides the improved response characteristics particularly for off-center hits. In other alternative embodiments, the body and the insert can be formed of other alternative shapes such as, for example, polygonal, triangular, trapezoidal, arcuate and combinations thereof.

Figure 11:
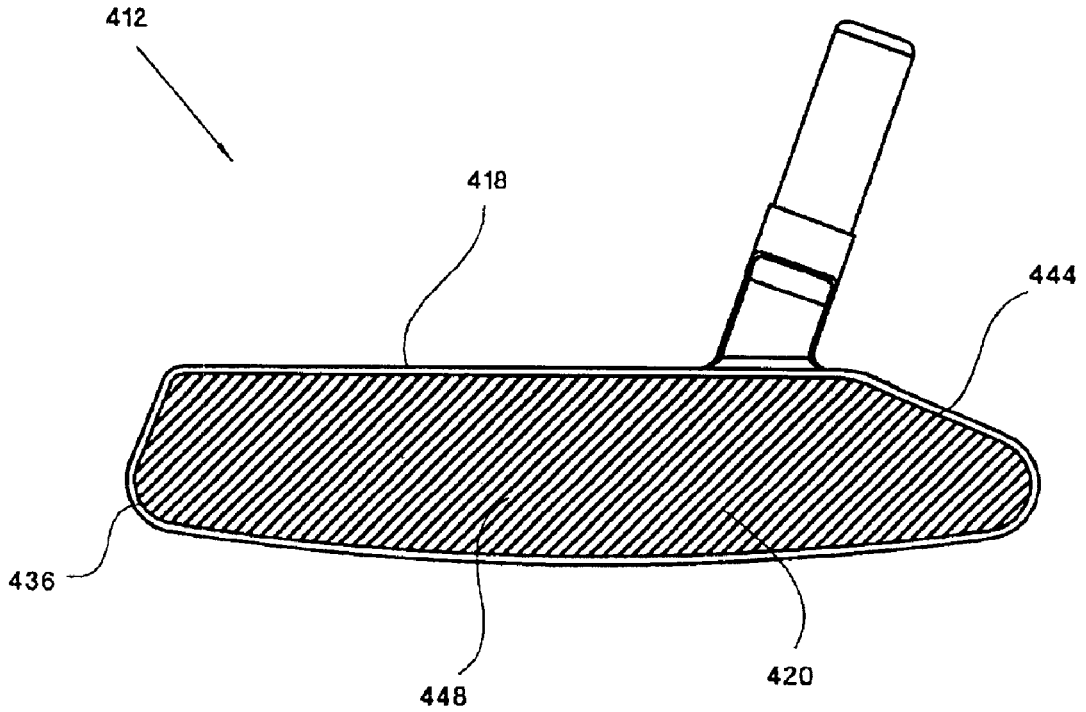
FIG. 11 is a front view of a putter head in accordance with another alternative preferred embodiment of the present invention.

Referring to FIG. 11, another alternative preferred embodiment of the present invention is illustrated. A putter head 412 includes a main body 418 having a front strike face 436 and an insert 420. The putter head 412 is substantially similar to the putter head 12 except that the recess 444 within the main body 418 substantially extends across the entire strike face 436 of the main body 418. The insert 420 substantially fills the recess 444 such that a front surface 448 of the insert 420 substantially extends across the strike face 436 of the putter head 412. In alternative preferred embodiments, the recess of the putter head and the insert are configured to extend across the front strike face of the putter head by an amount different from the putter head 12 and the putter head 412.

Figure 12:
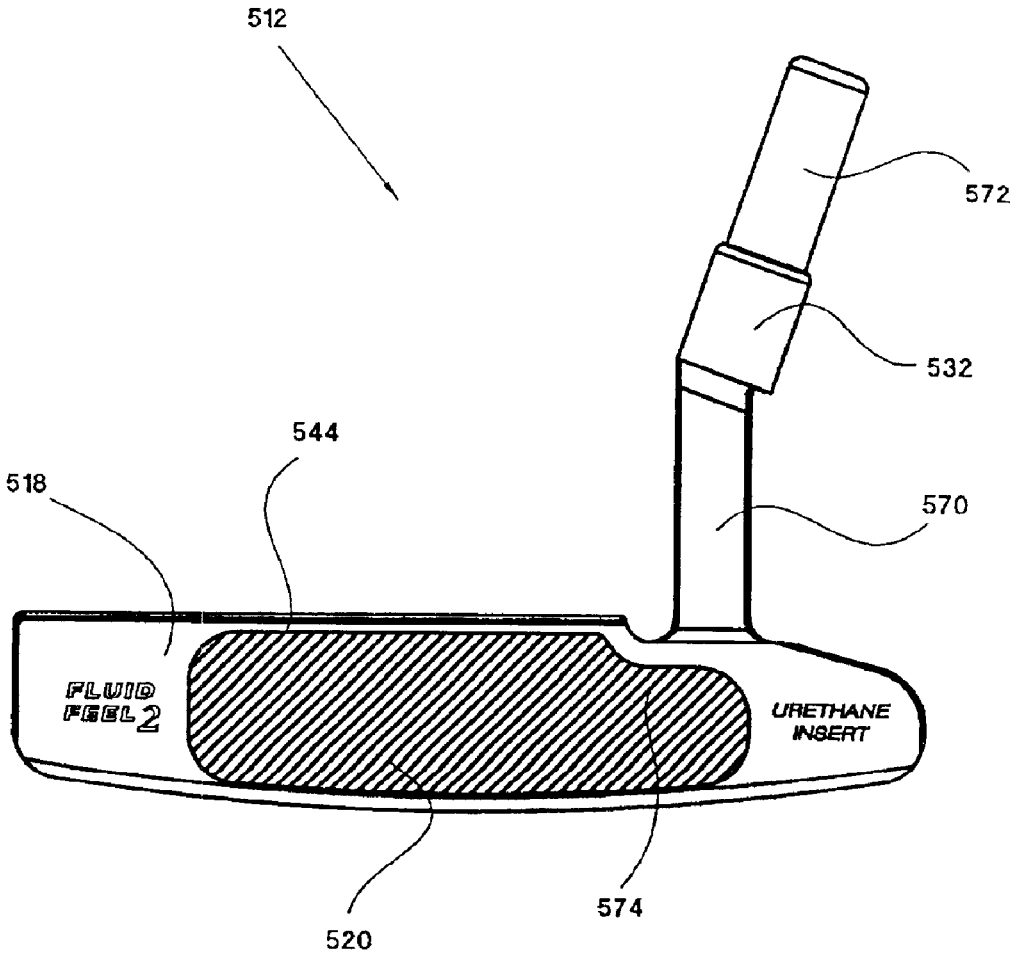
FIG. 12 is a front view of a putter head in accordance with another alternative preferred embodiment of the present invention.

Referring to FIG. 12, another alternative preferred embodiment of the present invention is illustrated. A putter head 512 includes a main body 518 and a hosel 532 upwardly extending from the main body 518. The hosel 532 includes a substantially vertical section 570 and an upwardly extending angled portion 572. A recess 544 is formed within the body 518 and an insert 520 is inserted within the recess 544. The insert 520 includes a shoulder 574 and the main body 518 defines a corresponding shoulder like shape adjacent to the shoulder 574 for accomodating the alternate hosel design. In other alternative embodiments, other hosel designs may also be used.

While the preferred embodiments of the present invention have been described and illustrated, numerous departures therefrom can be contemplated by persons skilled in the art, for example, the insert can be an insert assembly comprised of two or more insert segments. Therefore, the present invention is not limited to the foregoing description but only by the scope and spirit of the appended claims.

What is claimed is:

1. A putter head comprising:

a toe portion;

a heel portion;

a generally vertically extending wall, the wall having a front strike face, a rear portion, an upper layer, and a lower layer, the upper layer, the lower layer and the rear portion each extending from the heel portion to the toe portion to define a recess rearwardly extending into the wall from the strike face, the rear portion of the wall being formed with variable thickness thereby providing the recess with a variable rearward depth;

a sole portion rearwardly extending from a lower region of the wall, the sole portion having a rearmost surface; and a single, one-piece insert substantially filling the recess and connected to the wall, the insert having a front facing surface, a top surface, a bottom surface and a rear surface, generally the entire surface area of the front facing surface of the insert being exposed, the top and bottom surfaces being substantially covered by the wall, the front facing surface of the insert being substantially coplanar with the front strike face, the insert including a center portion having a first rearward depth, the putter head having a second rearward depth measured from the front strike face of the front wall to the rearmost surface of the sole portion, the first depth being less than fifty percent of the second depth.

2. The putter head of claim 1, wherein the sole portion has an upper surface, and wherein the upper surface has a sight line positioned substantially perpendicular to the strike face.

3. The putter head of claim 1, wherein the sole portion has an elongate through-sole slot disposed rearward of the insert and generally parallel to the strike face.

4. The putter head of claim 1, wherein the wall includes an upper rear edge generally extending from the heel portion to the toe portion, and wherein the upper rear edge is substantially parallel with the strike face to provide a top alignment line.

5. The putter head of claim 1, wherein the insert is a lightweight material selected from the group consisting of a urethane, an epoxy resin, a thermoplastic, a thermoset material, an elastomer, and combinations thereof.

6. The putter head of claim 1, wherein the insert is made of a translucent material.

7. The putter head of claim 1, wherein the insert is formed in a shape selected from the group consisting of trapezoidal, triangular, polygonal, semi-circular, semi-elliptical, and combinations thereof.

8. The putter head of claim 1, wherein the recess extends substantially across the entire width of the strike face.

9. The putter head of claim 1, wherein the insert is castably formed to the wall without the use of an adhesive.

10. The putter head of claim 1, wherein the strike surface has an intended strike region, and wherein the exposed front facing surface extends across the intended strike region of the strike face.

11. The putter head of claim 1, wherein the insert is formed of a material having a durometer of between 40 and 65 on a Shore A hardness scale.

12. The putter head of claim 1, wherein the insert is formed of a material having a durometer of between 45 and 55 on a Shore A hardness scale.

13. The putter head of claim 1, wherein the center portion of the insert includes is positioned between a toe end portion and a heel end portion, wherein the toe and heel portions of the insert have third and fourth rearward depths, respectively, and wherein the first rearward depth of the center portion is greater than either of the third and fourth rearward depths.

14. A putter head comprising:

a generally vertically extending wall having a front strike face and a rear surface, the wall having an insert region at the strike face defining a rearwardly extending recess of varying rearward depth;

a sole portion rearwardly extending from a lower region of the wall, the sole portion having a rearmost surface; and a single one-piece insert castably formed in the recess of the insert region, the insert having a front facing surface and a variable rearward depth to substantially fill the recess, the insert contacting the insert region of the wall, substantially the entire surface area of the front facing surface of the insert being substantially coplanar with the front strike face, the insert including a center portion having a first rearward depth, the putter head having a second rearward depth measured from the front strike face of the front wall to the rearmost surface of the sole portion, the first depth being less than fifty percent of the second depth.

15. The putter head of claim 14, wherein the sole portion has an upper surface, and wherein the upper surface has a sight line positioned substantially perpendicular to the strike face.

16. The putter head of claim 14, wherein the sole portion has an elongate through-sole slot disposed rearward of the insert and generally parallel to the strike face.

17. The putter head of claim 14, wherein the wall includes an upper rear edge generally extending from the heel portion to the toe portion, and wherein the upper rear edge is substantially parallel with the strike face to provide a top alignment line.

18. The putter head of claim 14, wherein the insert is a lightweight material selected from the group consisting of a urethane, an epoxy resin, a thermoplastic, a thermoset material, an elastomer, and combinations thereof.

19. The putter head of claim 14, wherein the insert is made of a translucent material.

20. The putter head of claim 14, wherein the insert is formed in a shape selected from the group consisting of trapezoidal, triangular, polygonal, semi-circular, semi-elliptical, and combinations thereof.

21. The putter head of claim 14, wherein the recess is defined in a central region of the strike face, and wherein the exposed front facing surface of the insert extends across the central region of the strike face.

22. The putter head of claim 14, wherein the recess extends substantially across the entire width of the strike face, and wherein the exposed front facing surface of the insert is generally coplanar with the strike face.

23. The putter head of claim 14, wherein the insert is formed of a material having a durometer of between 40 and 65 on a Shore A hardness scale.

24. The putter head of claim 14, wherein the insert is formed of a material having a durometer of between 45 and 55 on a Shore A hardness scale.

25. The putter head of claim 14, wherein the center portion of the insert includes is positioned between a toe end portion and a heel end portion, wherein the toe and heel portions of the insert have third and fourth rearward depths, respectively, and wherein the first rearward depth of the center portion is greater than either of the third and fourth rearward depths.

26. A putter head comprising:

a toe portion;

a heel portion;

a generally vertically extending wall extending from the toe portion to the heel portion, the wall having a front strike face and a rear surface;

a rearwardly extending recess defined into the strike face of the wall, the recess having varying rearward depth;

a single one-piece insert formed of a first material, the insert substantially filling the recess and connected to the wall; and a sole portion rearwardly extending from a lower portion of the wall, the sole portion having a rearmost surface, the portion having only one elongate through-sole slot, the through-sole slot disposed rearward of the insert and substantially parallel to the strike face, the insert including a center portion having a first rearward depth, the putter head having a second rearward depth measured from the front strike face of the front wall to the rearmost surface of the sole portion, the first depth being less than fifty percent of the second depth.

27. The putter head of claim 26, wherein the sole portion has an upper surface, and wherein the upper surface has a sight line positioned substantially perpendicular to the strike face.

28. The putter head of claim 26, wherein the wall includes an upper rear edge generally extending from the heel portion to the toe portion, and wherein the upper rear edge is substantially parallel with the strike face to provide a top alignment line.

29. The putter head of claim 26, wherein the first material of the insert is a lightweight material selected from the group consisting of a urethane, an epoxy resin, a thermoplastic, a thermoset material, an elastomer, and combinations thereof.

30. The putter head of claim 26, wherein the insert is formed in a shape selected from the group consisting of trapezoidal, triangular, polygonal, semi-circular, semi-elliptical, and combinations thereof.

31. The putter head of claim 26, wherein the recess extends substantially across the entire width of the strike face, and wherein the exposed front surface of the insert is generally coplanar with the strike face.

32. The putter head of claim 26, wherein the insert is castably formed to the wall without the use of an adhesive.

33. The putter head of claim 26, wherein the insert is formed of a material having a durometer of between 40 and 65 on a Shore A hardness scale.

34. The putter head of claim 26, wherein the insert is formed of a material having a durometer of between 45 and 55 on a Shore A hardness scale.

* * * * *